United States Patent [19]

Paladino

[11] 4,088,995

[45] May 9, 1978

[54] SYSTEM FOR SELECTIVELY OPERABLE DUAL SIMULTANEOUS SIREN BROADCAST FROM A SINGLE SPEAKER

[75] Inventor: C. Alfred Paladino, Costa Mesa, Calif.

[73] Assignee: International Telephone and Telegraph Corporation, New York, N.Y.

[21] Appl. No.: 772,067

[22] Filed: Feb. 25, 1977

[51] Int. Cl.[2] ..... G08B 3/00

[52] U.S. Cl. ..... 340/384 E; 340/384 R

[58] Field of Search ..... 340/384 E, 384 R

[56] References Cited

U.S. PATENT DOCUMENTS

| | | | |
|---|---|---|---|
| 3,378,624 | 4/1968 | Markowitz | 340/384 E |
| 3,493,966 | 2/1970 | Human | 340/384 E |
| 3,774,148 | 11/1973 | McIntosh | 340/384 E |
| 3,893,107 | 7/1975 | Schedler | 340/384 E |

*Primary Examiner*—Harold I. Pitts

*Attorney, Agent, or Firm*—A. Donald Stolzy

[57] ABSTRACT

A system for broadcasting two siren sounds simultaneously over a single speaker. This function is performed by adding or subtracting the signals.

1 Claim, 9 Drawing Figures

SOUND COMMUNICATION SYSTEM 20

FIG 1 SOUND COMMUNICATION SYSTEM 20'

FIG. 2 SOUND COMMUNICATION SYSTEM 20

CONTROL ASSEMBLY 31'

SYSTEM FOR SELECTIVELY OPERABLE DUAL SIMULTANEOUS SIREN BROADCAST FROM A SINGLE SPEAKER

BACKGROUND OF THE INVENTION

This invention relates to audio systems and, more particularly, sirens or the like for emergency or other vehicles.

In the past, siren systems have produced only one siren sound at a time.

SUMMARY

In accordance with the system of the present invention, the above-described and other disadvantages of the prior art are overcome by providing a multipurpose sound communication system comprising: first and second oscillators having first and second output leads, respectively, said first and second oscillators producing respective first and second periodic output signals on said first and second output leads thereof which have magnitudes that are first and second different predetermined periodic functions of time, respectively; a driver stage having an input lead, said driver stage being constructed to amplify audible sound when at least one signal of an audio frequency is impressed upon said driver stage input lead; and switch means actuable to connect simultaneously said first and second oscillator amplified outputs or some portion thereof to said driver stage input.

The above-described and other advantages of the present invention will be better understood from the following detailed description when considered in connection with the accompanying drawings.

BRIEF DESCRIPTION OF THE DRAWINGS

In the drawings which are to be regarded as merely illustrative.

DESCRIPTION OF THE PREFERRED EMBODIMENTS

Figure 1:
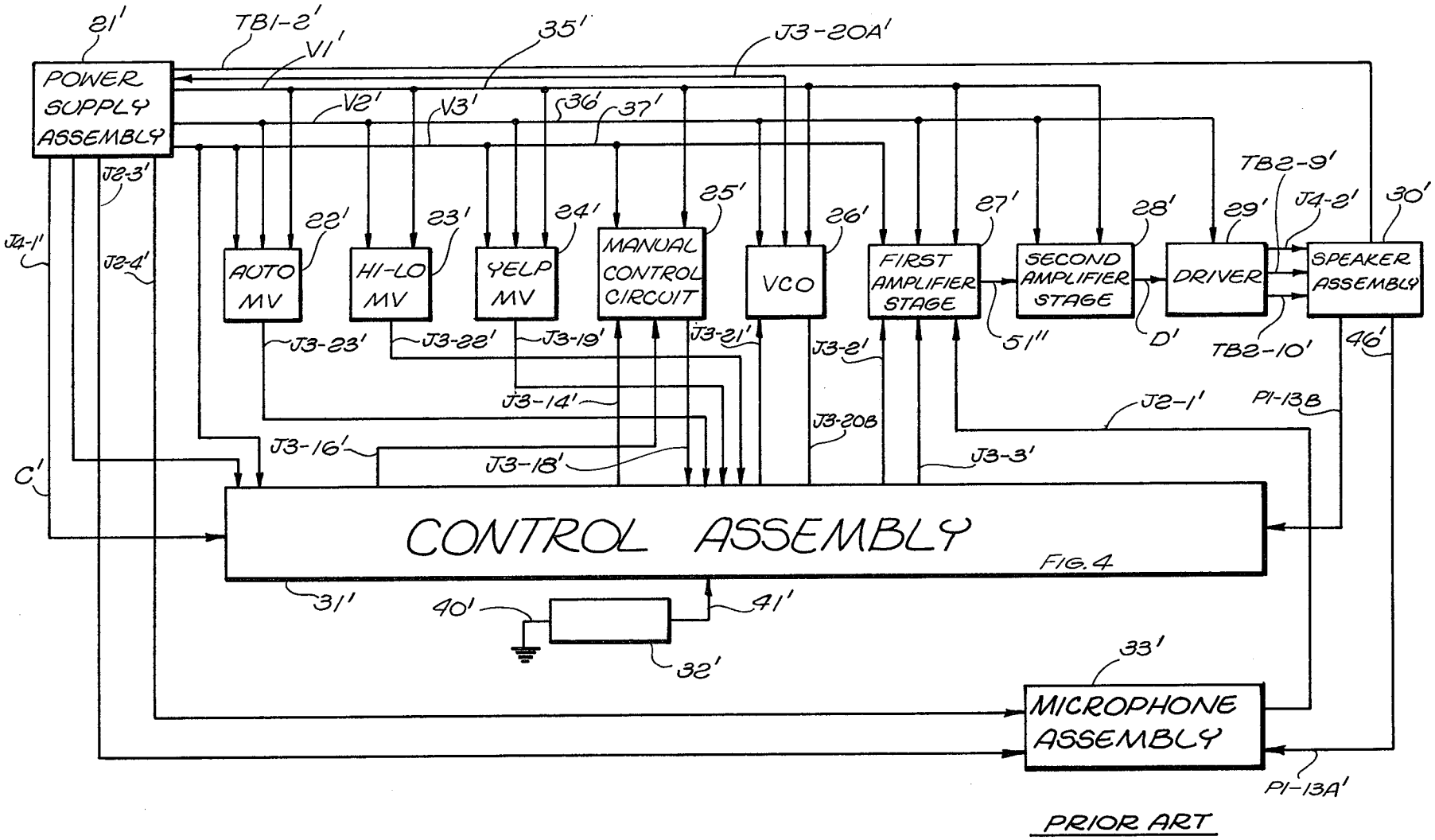
FIG. 1 is a block diagram of a prior art sound communication system.

In the drawings, in FIG. 1, a sound communication system 20' is shown including a power supply assembly 21', an AUTO MV 22', a HI-LO MV 23', a YELP MV 24', a manual control circuit 25', a voltage controlled oscillator (VCO) 26', a first amplifier stage 27', a second amplifier stage 28', a driver 29', a speaker assembly 30', a control assembly 31', a radio 32' and a microphone assembly 33'.

Power supply assembly 21' has output leads 35', 36' and 37' which are maintained at potentials V1, V2 and V3, respectively. The lead 35' of potential V1 is connected to AUTO MV 22', HI-LO MV 23', YELP MV 24', manual control circuit 25', VCO 26', first amplifier stage 27' and second amplifier stage 28'. The lead 36' of potential V2 is connected to AUTO MV 22', HI-LO MV 23', YELP MV 24', VCO 26', first amplifier stage 27', second amplifier stage 28' and driver 29'. The lead 37' of potential V3 is connected to AUTO MV 22', YELP MV 24', manual control circuit 25', first amplifier stage 27' and to control assembly 31'.

Power supply assembly 21' has a lead TB1-2' connected to speaker assembly 30', leads C' and J4-1' connected to control assembly 31', and leads J2-3' and J2-4' connected to microphone assembly 33'.

The VCO 26' has output leads J3-20A' and J3-20B' connected to power supply assembly 21' and to control assembly 31', respectively. The VCO 26' has an input lead J3-21' connected from control assembly 31'.

The AUTO MV 22' has an output lead J3-23' connected to control assembly 31'.

The HI-LO MV 23' has an output lead J3-22' connected to control assembly 31'.

The YELP MV 24' has an output lead J3-19' connected to control assembly 31'.

The manual control circuit 25' has an input lead J3-14' and two output leads J3-16' and J3-18' connected to and from control assembly 31', respectively.

First amplifier stage 27' has input leads J3-2' and J3-3' connected from control assembly 31', and an output lead 51'' connected to second amplifier stage 28'.

A lead J2-1' is connected from microphone assembly 33' to first amplifier stage 27'.

The output lead 51'' of first amplifier stage 27' serves as an input lead of second amplifier stage 28'. A lead D' connects the output of a second amplifier stage 28' to the input of driver 29'.

Leads TB2-9', TB2-10' and J4-2' connect the outputs of driver 29' to speaker assembly 30'.

Speaker assembly 30' has output leads P1-13A' and P1-13B' connected to microphone and control assemblies 33' and 31', respectively.

Radio 32' has one side grounded at 40' and has an output lead 41' which is connected to control assembly 31'.

The entire system 20' shown in FIG. 1 may be identical to that shown in Carroll, U.S. Pat. No. 3,882,275, issued May 6, 1975.

Figure 2:
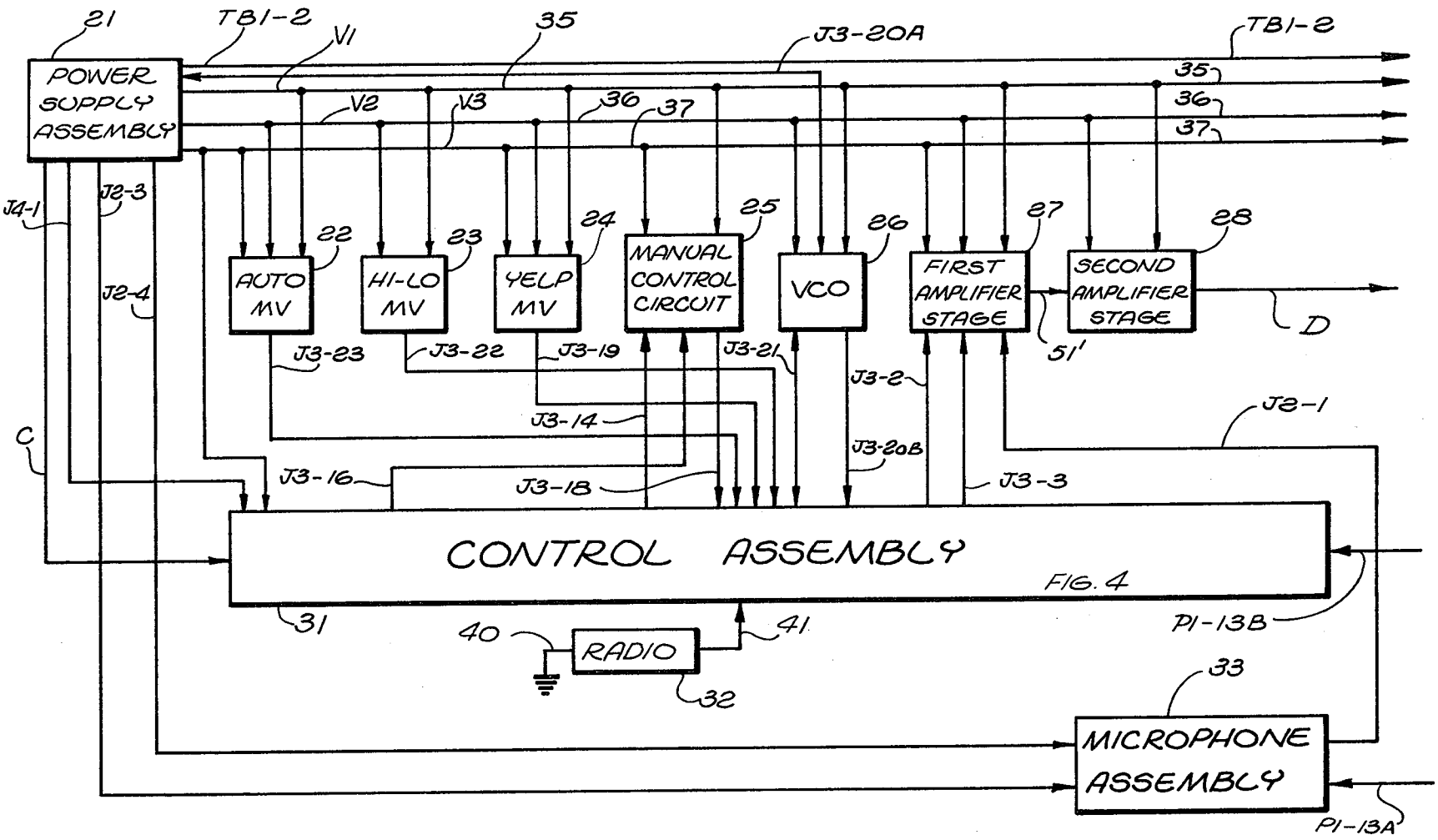
FIGS. 2 and 3 are schematic diagrams of a sound communication system constructed in accordance with the present invention.
Figure 3:
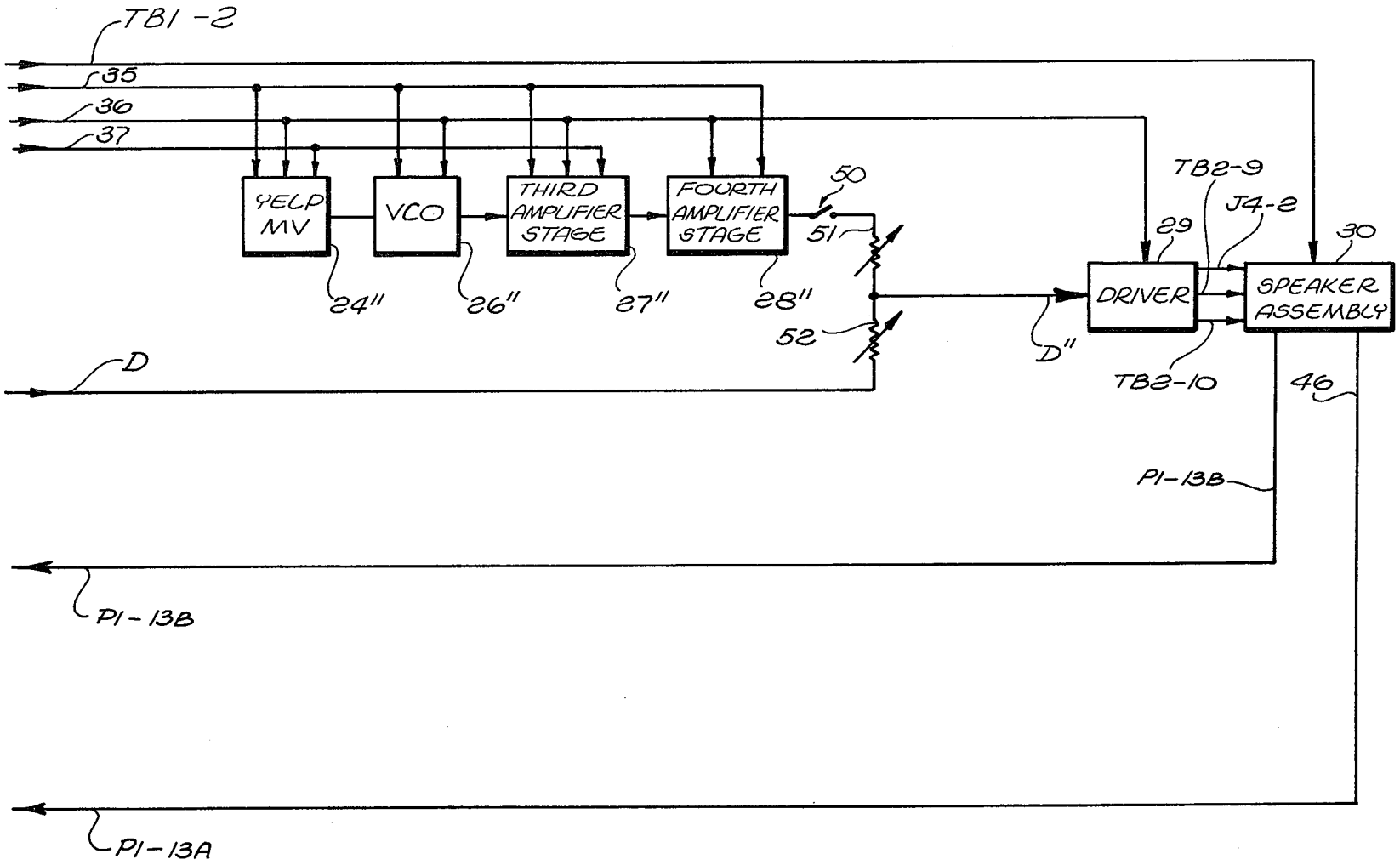
Figure 5:
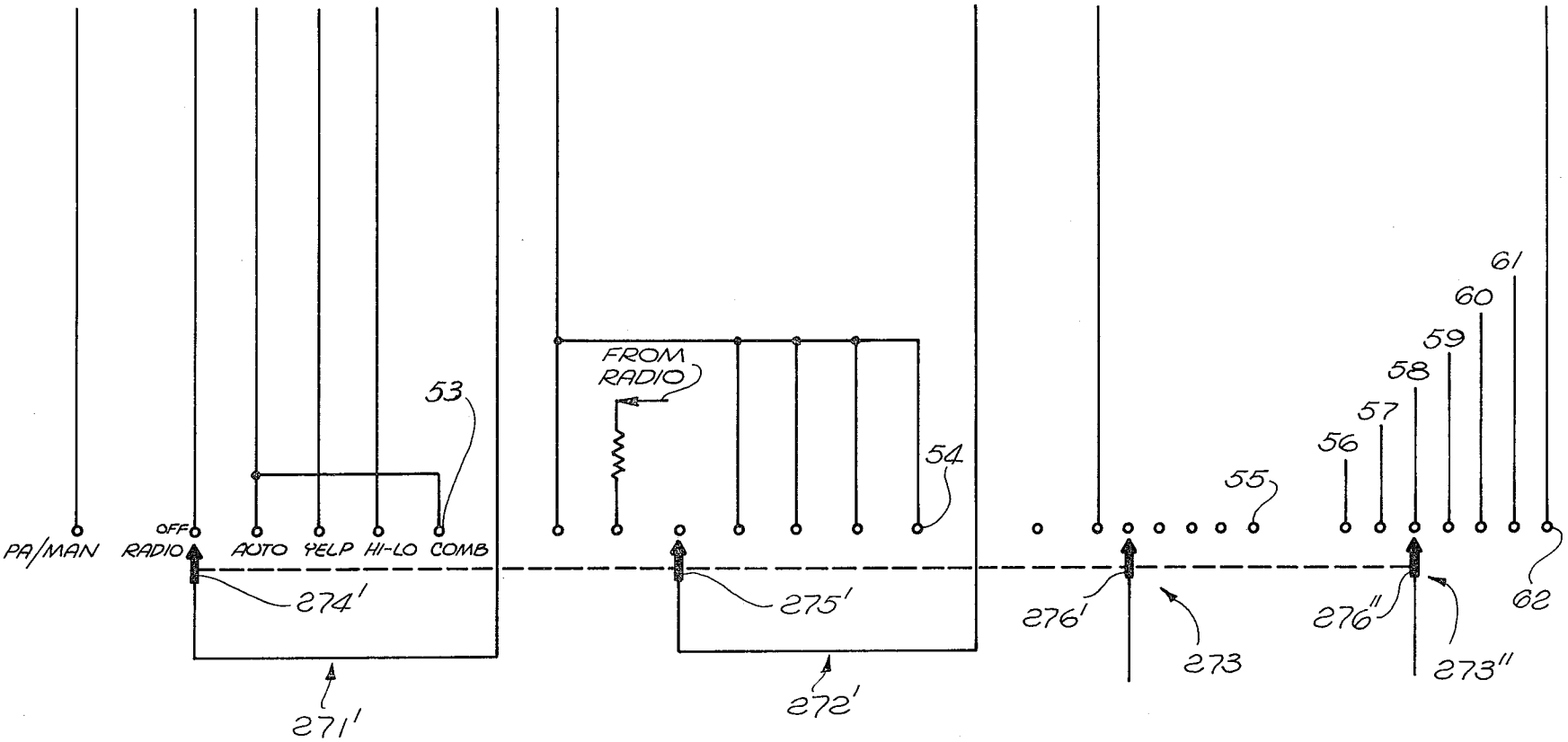
FIG. 5 is a schematic diagram of a control assembly constructed in accordance with the present invention.

Two embodiments of the present invention are illustrated in FIGS. 2, 3 and 5.

FIG. 2 is identical to FIG. 1 except that driver 29', speaker assembly 30' and portions or all of leads D', 36', TB1-2', J4-2', TB2-9', TB2-10', P1-13B', 46', and P1-13A' have been omitted, whereas the same or some other leads P (TB1-2', 36', 35', 37', D', P1-13B', P1-13A') have been extended, and one prime mark has been removed from each reference character.

The lead arrows to and from the left-hand side of FIG. 3 come from corresponding leads from and to the right-hand side of FIG. 2, respectively.

The lead D'' to driver 29 has replaced the lead to driver 29' in FIG. 1, but drivers 29 and 29', per se, may be identical if desired. Speaker assemblies 30' and 30, and the leads thereto and therefrom may all be identical, if desired. YELP MV 24'', VCO 26'', third amplifier stage 27'', and fourth amplifier stage 28'' may be identical to and identically connected as YELP MV 24, VCO 26, first amplifier stage 27, and second amplifier stage 28, respectively, if desired, whereas the output of fourth amplifier stage 28'' is connected to driver 29 only through a variable resistor 51.

Figure 4:
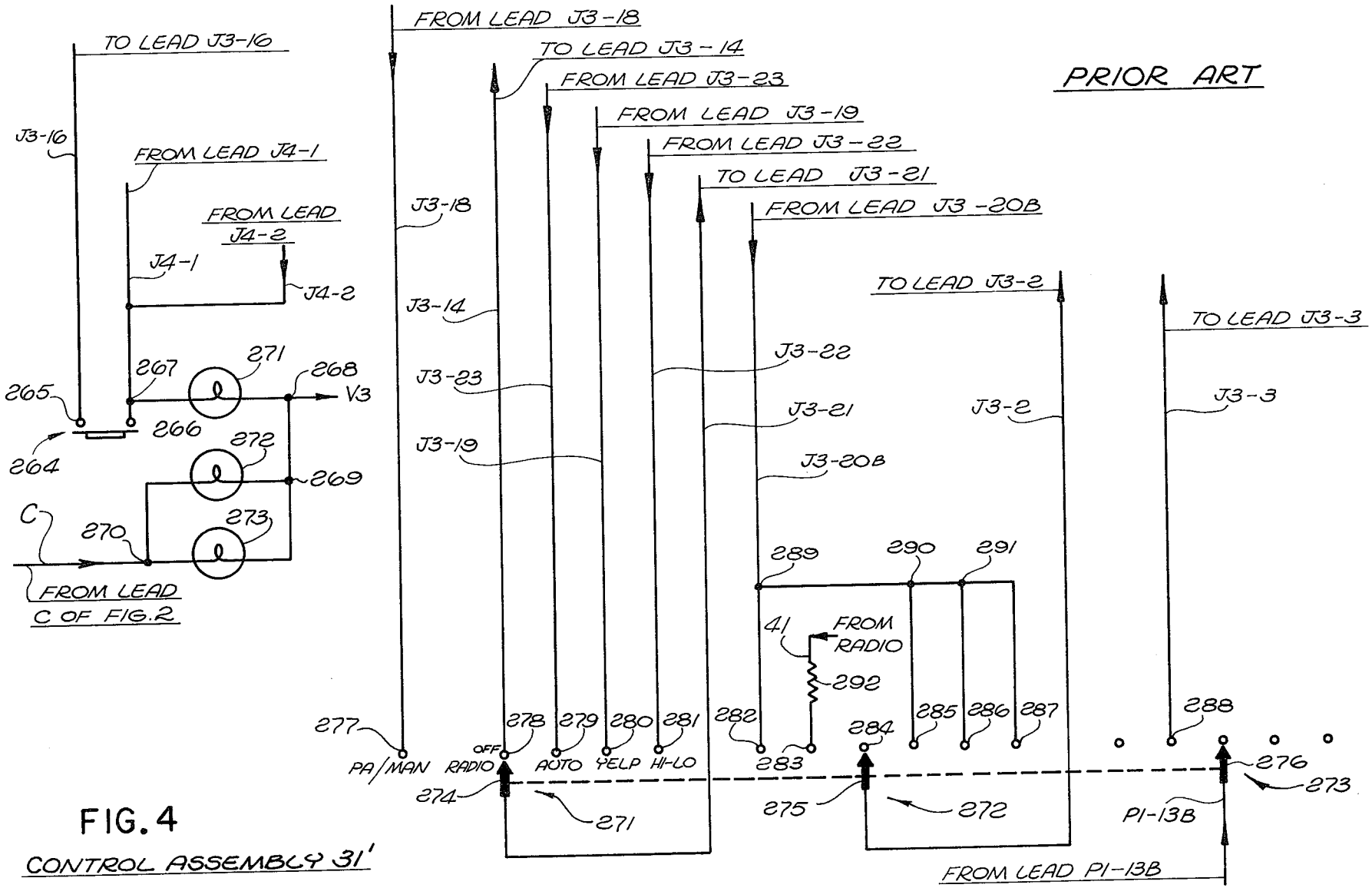
FIG. 4 is a schematic diagram of a prior art control assembly.

When pole 274 of ganged switch 271 in FIG. 4 is moved to engage contact 279, switch 50 in FIG. 3 may be opened or closed. If switch 50 is opened, the embodiment of the present invention may operate exactly the same as that disclosed in the said patent. Note that control assembly 31 in FIG. 2 may be conventional as shown in FIG. 4, if desired. Alternatively, control assembly 31 may be as indicated in FIG. 5.

If switch 50 in FIG. 3 is closed while the pole 274 of FIG. 4 engages contact 279, the output of speaker assembly 30 is the sum of the frequency modulated outputs of the VCO 26 and the VCO 26". The same is true if and when poles 271', 272', 273' and 273" engage contacts 53, 54, 55 and 62, respectively, as shown in FIG. 5. The outputs of VCO 26 and VCO 26" or some portion thereof are added at variable resistors 51 and 52 shown in FIG. 3.

If control assembly 31 is as shown in FIG. 5, switch 50 in FIG. 3 may be replaced by the series connection from pole 276" to contact 62 or vice versa as shown in FIG. 5.

Note that in FIG. 5, the poles and contacts are identical to those of FIG. 4, except that contacts 53, 54, 55, 56, 57, 58, 59, 60, 61, and 62, have been added, and pole 273" has been added. However, pole 273" is ganged with poles 271', 272', and 273', as before. Control assembly 31 may otherwise be identical to that shown in FIG. 4, if desired.

A lead C is connected from power supply assembly 21 to lead C of control assembly 31 shown in FIG. 4.

Lead TB1-2 is connected from power supply assembly 21 to lead TB1-2 of speaker assembly 30 as before.

Leads J2-3 and J2-4 are connected from power supply assembly 21 to the same leads, lead J2-3 and J2-4, respectively, of microphone assembly 33.

A lead J4-1 is connected from power supply assembly 21 to lead J4-1 of control assembly 31.

A lead J3-20 is connected to power supply assembly 21 from lead J3-20A of VCO 26.

A lead J3-23 is connected from AUTO MV 22 to lead J3-23 of control assembly 31.

A lead J3-22 is connected from HI-LO MV 23 to the same lead J3-22 of control assembly 31.

As used herein, the phrase "connected to potential" is hereby defined to mean "connected to a member including, but not limited to, a conductive lead or a conductive junction which has a potential."

A lead J3-14 is connected to manual control circuit 25 from the same lead J3-14 of control assembly 31.

Leads J3-16 and J3-18 are connected from manual control circuit 25 to the same leads J3-16 and J3-18, respectively, of control assembly 31.

A lead J3-21 is connected from the same lead J3-21 of control assembly 31 to VCO 26.

A lead J3-20B is connected from VCO 26 to the same lead J3-20B of control assembly 31.

The first amplifier stage 27 has an input lead J3-2 connected from the same lead J3-2 of control assembly 31.

Lead J2-1 to first amplifier stage 27 is connected from the same lead J2-1 of microphone assembly 33. Lead J3-3 to first amplifier stage 27 is connected from the same lead J3-3 of control assembly 31.

A lead TB2-10 is connected from driver 29 to the same lead TB2-10 in speaker assembly 30.

A lead J4-2 is connected from driver 29 to the same lead J4-2 of speaker assembly 30.

A lead TB2-9 connected from driver 29 is connected to the same lead TB2-9 of speaker assembly 30.

Lead J2-3 is connected from power supply assembly 21 to microphone assembly 33.

Lead P1-13A is connected from speaker assembly 30 to microphone assembly 33.

Control assembly 31 is shown in FIG. 4 including leads J3-16, J4-1, J4-2, J3-18, J3-14, J3-23, J3-19, J3-22, J3-21, J3-20B, J3-2 and J3-3, all of which are connected to or from leads of the same reference characters respectively illustrated in FIG. 2.

A switch is provided at 264. Switch 264 is a conventional momentary contact switch which is spring biased open and is, therefore, normally open.

Switch 264 has contacts 265 and 266 connected respectively to leads J3-16 and a junction 267.

Other junctions are provided at 268, 269 and 270. A lamp 271 is connected between junctions 267 and 268. Two lamps 272 and 273 are connected in parallel between junctions 269 and 270. Junctions 268 and 269 are connected together. Junction 268 is maintained at potential V3. Lead C is connected to junction 270 from the same lead C of power supply assembly 21 shown in FIG. 2.

Also shown in FIG. 4 are three switches 271, 272, and 273 which have respective poles 274, 275 and 276.

The switches 271, 272 and 273 are ganged. Each of the switches 271, 272 and 273 is a six-position switch.

Switch 271 has contacts 277, 278, 279, 280 and 281.

Switch 272 has contacts 282, 283, 284, 285, 286 and 287.

Switch 273 has a contact 288.

Pole 274 of switch 271 is connected to the lead J3-21.

The pole 275 of switch 272 is connected to the lead J3-2.

The pole 276 of switch 273 is connected from the lead P1-13B connected from the same lead P1-13B of speaker assembly 30 shown in FIG. 2.

Other junctions 289, 290 and 291 are shown in FIG. 4, all three of these junctions being connected together. Lead J3-20B and contact 282 of switch 272 are connected from junction 289. Junctions 290 and 291 are connected respectively from contacts 285 and 286. Junction 291 is also connected to contact 287. A resistor 292 is connected from contact 283 to radio 32 shown in FIG. 2 over lead 41.

Figure 6:
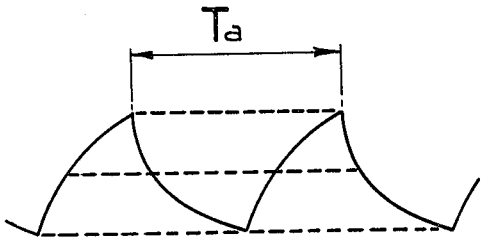
FIGS. 6–9 are graphs of a group of waveforms characteristic of the operation of the sound communication system of the present invention and some of the prior art as illustrated in FIGS. 1–9, inclusive.

The voltage which appears at the output of AUTO MV 22 is illustrated in FIG. 6. The fundamental of the waveform of FIG. 6 may have a period equal to $T_a$. In a typical example, $T_a$ might be 8.0 seconds.

Figure 7:
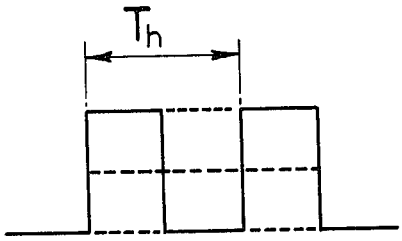

The voltage which appears on lead J3-22 at the output of HI-LO MV 23 in FIG. 2 is illustrated in FIG. 7. The period $T_h$ of the waveform shown in FIG. 7 may typically be 2.0 seconds.

Figure 8:
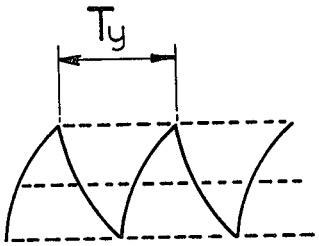

The YELP MV 24 and the YELP MV 24" shown in FIGS. 2 and 3, respectively, may be identical to the AUTO MV, if desired, with the exception that some circuit values may change. The voltage which appears on the output leads of the YELP MV 24 and the YELP MV 24" is illustrated in FIG. 8. In this illustration, the fundamental period $T_y$ may be, for example, 0.5 seconds.

Figure 9:
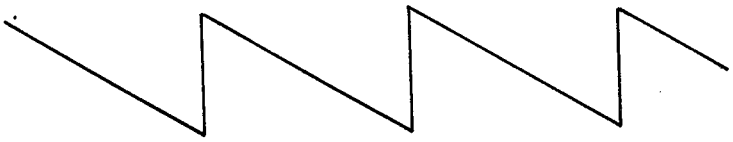

The output voltages of VCO 26 and VCO 26" may have a wave shape as shown in FIG. 9, although both may be frequency modulated.

In order to make the foregoing as clear as possible, it should be stated that all the functions illustrated in FIGS. 6–9 are potentials which are graphed as different functions of time.

The minimum and maximum frequencies of VCO 26 and VCO 26'' for the AUTO MV and YELP MV modulations may be 400 Hz and 1600 Hz, respectively. The YELP MV minimum and maximum variation rates may be 120 and 200 cycles per minute, respectively. The AUTO MV minimum and maximum variation rates may be 10 and 30 cycles per minute, respectively.

The output signal of VCO 26 and or VCO 26'' may be sawtooth or any other periodic wave.

AUTO MV 22, HI-LO MV 23 and YELP MV 24 and YELP MV 24'' all may be conventional multivibrators.

When pole 274 of switch 271 in FIG. 4 is placed in engagement with contact 277, the output of manual control circuit 25 on lead J3-18 shown in FIG. 2 is connected to the input of VCO 26 over the lead J3-21 shown in FIG. 4.

In FIG. 2, diode 65 protects all portions of the circuits connected from junctions 56, 58 and 60 when battery 61 is connected between terminals 62 and 63 with the wrong polarity.

Capacitor 69 provides a small amount of voltage regulation.

As shown in FIG. 2, AUTO MV 22 has an output on lead J3-23 which is connected to control assembly 31 in FIG. 4. YELP MV 24 may be identical to AUTO MV 22 except for the changes in circuit values.

The output of HI-LO MV 23 is connected to control assembly 31 of FIG. 4 over lead J3-22.

When switch 264 in FIG. 4 is closed, 6 volts, for example, are impressed upon lead J3-16 in FIG. 2.

In FIG. 6, the input to VCO 26 is supplied over lead J3-21. The output of VCO 26 is supplied over leads J3-20A and J3-20B.

First amplifier stage 27 receives negative feedback over lead J3-3. This is added to the input on lead J3-2. The output of first amplifier stage 27 is connected to the input of second amplifier stage 28 over a lead 51'. First amplifier stage 27 has an input lead J3-2. Second amplifier stage 28 has an output lead D.

First amplifier stage 27 receives negative feedback in two ways. This negative feedback is supplied over lead J2-1 and over lead J3-3. The feedback over lead J2-1 comes from lead P1-13A of speaker assembly 30 to lead J2-1.

Negative feedback is supplied over lead J3-3 from lead P1-13B of speaker assembly 30 to lead J3-3 in control assembly 31 of FIG. 4.

Leads TB2-10, TB2-9 and J4-2 connect the outputs of driver 29 to speaker assembly 30.

Driver 29 receives an input signal over lead D of second amplifier stage 28.

VCO 26 and VCO 26'' may be conventional. The same is true of first and second amplifier stages 27 and 28, driver assembly 29 and speaker assembly 30.

OPERATION

In the operation of the sound communication system 20 shown in FIG. 2, when pole 274 of switch 271, shown in control assembly 31 of FIG. 4, is moved to contact 279, as viewed in FIG. 4, and switch 50 is open (FIG. 3), the output of speaker assembly 30 is a "WAIL." When pole 274 of switch 271 is moved to contact 280 and switch 50 is open, the output of speaker assembly 30 is a "YELP." However, when pole 274 engages contact 279 and switch 50 is closed, both YELP and WAIL (AUTO) are heard in what seems to be a simultaneous yet individual fashion.

As shown in FIG. 4, contacts 282, 285, 286 and 287 are all connected from the output of VCO 26 over lead J3-20B therefrom.

No contact need be provided at 284 for pole 275 to engage because nothing need be connected to any contact at the position 284 of pole 275 of switch 272.

With the poles 274, 275 and 276 of the respective switches 271, 272 and 273 in the positions shown in FIG. 4, the control assembly 31 is in the OFF position.

When the pole 274 of switch 271 in FIG. 4 engages contact 279, speaker 248 produces a siren sound which is in common use today.

When pole 274 engages contact 280, speaker 248 produces a sound which is commonly used on board ship in the U.S. Navy to signal an alert.

When pole 274 is placed in engagement with contact 281, the speaker 248 produces a sound which is commonly used on emergency vehicles in European countries.

Each of the AUTO, HI-LO and YELP multivibrators are constructed to produce a periodic output signal susceptible to Fourier analysis.

Some of the prior art related to the field of the present invention, but not the invention per se, includes U.S. Pat. Nos. 3,137,846 issued June 16, 1964; 3,882,275 issued May 6, 1975; and 3,889,256 issued June 10, 1975. Other prior art includes *Electronic Design* 20, Sept. 27, 1967.

If desired, all the multivibrators disclosed herein may be conventional or of a type and for use with operational amplifiers identified herein as differential amplifiers disclosed in the book *Operational Amplifiers* by L. P. Hullsman (McGraw-Hill Book Company, 1971).

Preferably, radio 32, shown in FIG. 2, is grounded at 40.

What is claimed is:

1. A sound communication system comprising: a first modulating oscillator having a first output lead, said first modulating oscillator producing a first signal on said first output lead thereof; a second modulating oscillator having a second output lead, said second modulating oscillator producing a second signal on said second output lead thereof, different from said first signal; a first voltage controlled oscillator (VCO) having a first input lead and a third output lead, said first VCO producing a third signal on said third output lead; a second VCO having a second input lead and a fourth output lead, said second VCO producing a fourth signal on said fourth output lead; a loudspeaker having an input lead, said first output lead being connected to said first input lead, said second output lead being connected to said second input lead; and means connected from said third output lead and said fourth output lead to said loudspeaker input lead for impressing a signal upon said loudspeaker input lead directly proportional to the sum of said third and fourth signals.

* * * * *